United States Patent [19]

Smith

[11] 4,391,006

[45] Jul. 5, 1983

[54] TRANSFER BENCH

[76] Inventor: Alfred A. Smith, 13114 Margate St., Van Nuys, Calif. 91401

[21] Appl. No.: 379,077

[22] Filed: May 17, 1982

[51] Int. Cl.[3] ..... A47K 3/00; A47K 3/02; A47K 3/022; A47K 3/22

[52] U.S. Cl. ..... 4/559; 4/571; 4/573; 4/578; 4/579; 4/611

[58] Field of Search ..... 4/559, 560, 611, 561, 4/562, 563, 565, 571, 573, 578, 579; 5/81 R, 81 B

[56] References Cited

U.S. PATENT DOCUMENTS

| | | | |
|---|---|---|---|
| 2,237,076 | 4/1941 | Kenney et al. | 4/559 |
| 2,648,849 | 8/1953 | Webb et al. | 4/560 |
| 3,090,969 | 5/1963 | Maling | 4/611 |
| 3,169,253 | 2/1965 | Segar | 4/611 |
| 3,289,217 | 12/1966 | Glover | 4/562 |
| 3,703,733 | 11/1972 | McLoughlin | 4/556 |
| 3,758,894 | 9/1973 | Finley | 4/560 |
| 4,091,479 | 5/1978 | Hancock | 4/560 |
| 4,150,445 | 4/1979 | Bailey | 4/546 |
| 4,166,297 | 9/1979 | Saleeby | 4/578 |
| 4,168,549 | 9/1979 | Davies | 4/578 |
| 4,253,203 | 3/1981 | Thomas | 4/559 |
| 4,359,791 | 11/1982 | Thomas | 4/546 |

*Primary Examiner*—Henry K. Artis

[57] ABSTRACT

A transfer bench for use in enabling an invalid to be moved at least partially into a bathtub, either from a wheelchair or standing position, comprised of an approach seat extending partly outside the front side wall of the bathtub and a main seat assembly disposed directly over the center of the bathtub. Both the approach seat and main seat assembly are supported by a pair of parallel bar members, each of which includes a horizontal section and inner end turned downwardly to rest on the floor of the tub. The opposite end of each bar member serves as one part of a clamp upon the front side wall of the tub and to support the approach seat. The other part of the clamping means consists of a vertical element extending downwardly from the horizontal section of the main bar member and disposable on such bar member in any one of the plurality of positions for generally positioning the clamping means. The lower end of each vertical element carries a threaded member having a plate at one end and a knob at its other end to provide for a more precise clamping on the front side wall of the tub. The transfer bench may be readily disassembled for removal and packing or storage in a limited space.

6 Claims, 4 Drawing Figures

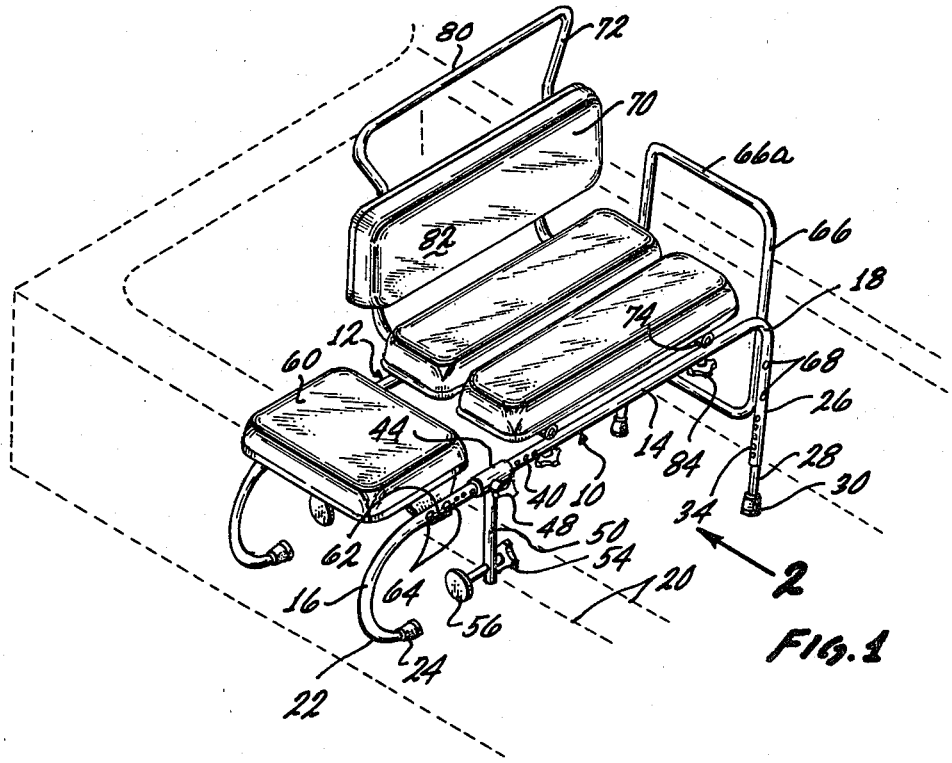
FIG. 1
FIG. 2
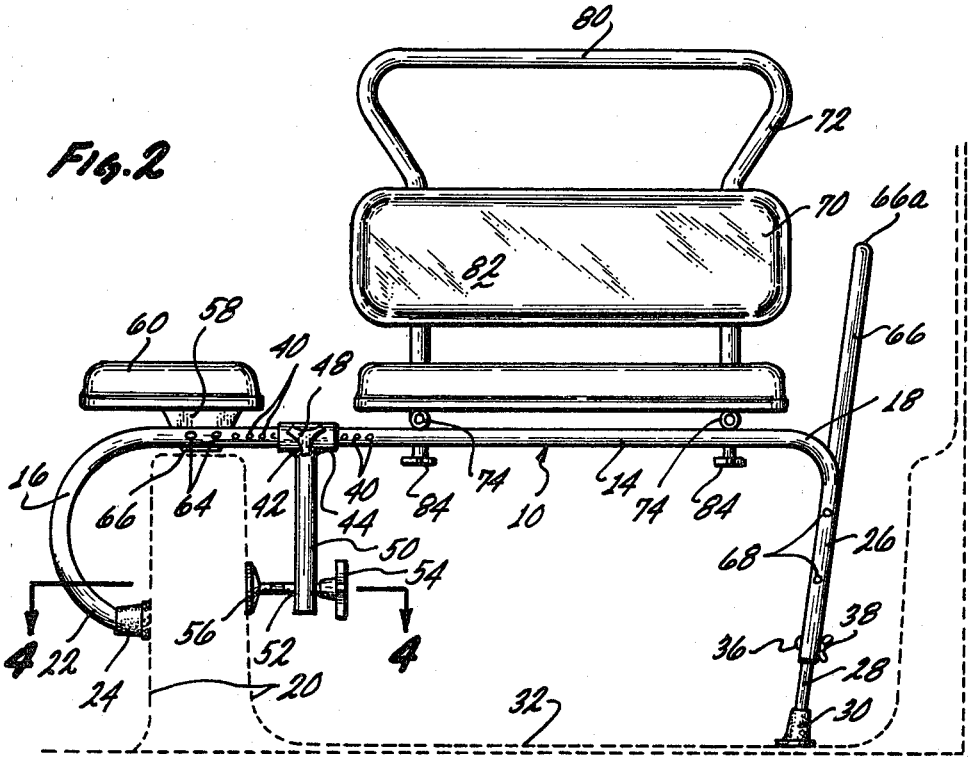

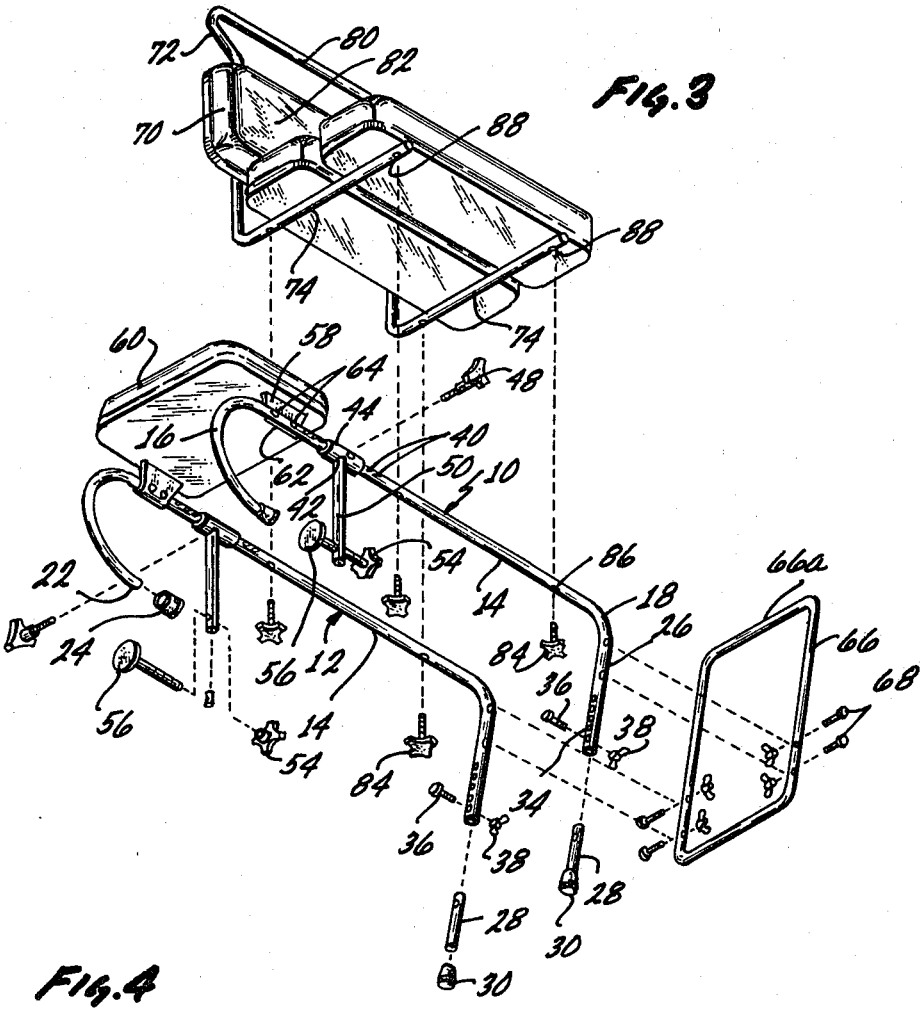
Fig. 3
Fig. 4
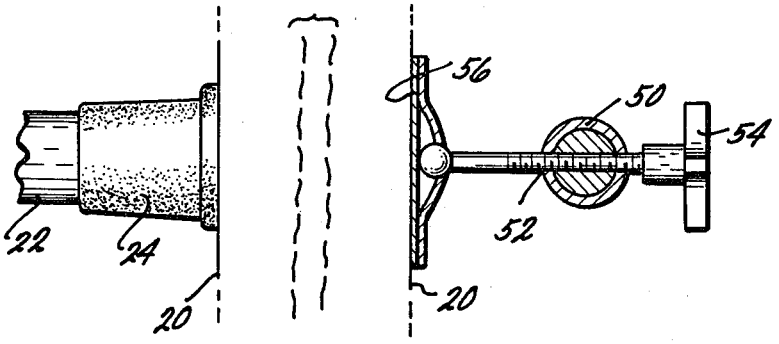

TRANSFER BENCH

FIELD OF THE INVENTION

This invention relates generally to the field of durable medical goods and, in particular, to special patient support devices known as transfer benches.

DESCRIPTION OF THE PRIOR ART

The necessity of providing some type of transfer bench to enable invalids and infirm or handicapped people to be placed, at least partially, within a conventional bathtub, has long been recognized. Heretofore, however, some transfer benches which have been devised and offered for such purpose, have utilized suction cups provided on the bottoms of at least those supporting legs which extend downwardly onto the floor of the tub in order to anchor such legs. The legs on the opposite end of the bench support may rest on the bathroom floor outside of the tub and may, or may not, utilize suction cups to secure such legs to the latter floor. In the usual case, the outside legs may simply be provided with a conventional rubber tip, such as is found on crutches, canes and other walking aids. In some instances, the transverse bench support from which the legs extend downwardly, is intended to rest upon the rim of the side wall of the tub in order to provide additional support. This, of course, requires that the legs be height adjustable in order to accommodate different heights of tub walls. However, because the height adjustments are usually represented by a series of steps, instances frequently occur where it is impossible for the two pairs of legs to be properly adjusted to enable the bench support actually to rest on the rim of the tub wall. Since the principal support for prior art transfer benches is in the form of the four legs, these should desirably be integrally secured to the element or elements which provide the transverse support for patient seating. The result is that prior art transfer benches have been bulky from the standpoint of handling and not easy to install. In addition, dependence upon suction cups as bases for the legs extending down to the floor of the tub requires that careful attention be given to the implantation of the suction cups. When the tub is filled with water, this can render such implantation difficult, and any leakage of water into the actual suction areas of the cups may result in a release of their holding power. Thereby, the tub implanted legs may be found to move, with resulting instability in the entire transfer bench to the danger, or at least discomfort, of the invalid or infirm person who is being aided into the tub.

Where a prior art transfer bench does not use any suction cups on any of its four legs, but simply involves the placement of two rubber-tipped legs inside the tub on its floor and the other two outside the tub on the bathroom floor, the entire bench can become quite unstable—particularly when the tub may become filled with soapy, or even plain, bath water. Any such instability, of course, becomes quite unacceptable to anyone, and especially to, and for assisting, an invalid or infirm person.

DESCRIPTION OF THE PRESENT INVENTION

The present invention obviates the principal criticisms of prior art transfer benches by avoiding dependence upon suction cups, providing complete stability and constructing the transfer bench of a total of six basic members (excluding the seating cushions) which may be readily assembled into the complete bench, or may be disassembled for removal and storage in a relatively small space.

While the transfer bench of the present invention does employ two back legs which extend down to the floor of the tub adjacent the rear side wall of the tub, its principal support is provided by an effective clamping action on the opposite and front side wall of the tub. The present invention utilizes two transverse support members, each of which has a horizontal section and a first curved end portion which extends forwardly over the rim of the tub's front side and back around to press against the outside of the tub front side wall. Extending downwardly from the horizontal section, just inside past the tub's front side wall, is a T-shaped member, the upper crossing portion of which comprises a sleeve surrounding, and slidable relative to, the horizontal section of each bar member, but securable by fastener means at any one of the series of positions along such horizontal section. The base of this "T" member carries a transversely extending threaded element which, when turned by an inner operating handle or knob, causes such threaded element, and a plate secured to its end, to move toward or away from the terminus of the first end of the horizontal bar member, which terminus is in abutment with the outside of the tub wall. Thereby, the tub wall may be clamped between such terminus and the plate-like end on the threaded element.

The opposite end of each bar member is curved downwardly to form a leg which is hollow and is provided with an extendable height adjustable coaxial foot member. The latter may be rubber tipped at its lower end and is positioned to rest on the floor of the tub. Desirably, the leg portion of each bar member is angled back at least slightly away from the back side wall of the tub to which it is most adjacent.

The two bar members are maintained in parallel and in spaced relationship with each other by means of (1) a frame member secured between the legs of said bar members, and (2) a rigid cushion support element which is secured to the first end portion of each bar member at a point just before it curves around downwardly and back to the outside of the front side wall of the tub. The main seat for the bench may comprise a U-shaped tubular member having its straight ends extending across and secured to the parallel main support bar members to support one or more cushions, with the "U" portion of the tubular member being bent upwardly some ninety degrees and traversed by a cushion to form a back support.

All tubular members may be joined together by bolts, wing nuts, and knob-headed fasteners so that practically the entire transfer bench of the present invention may readily be assembled or disassembled without the use of any tools. Upon disassembly, the several components may be packed or stored in a relatively small space.

The principal advantage of the transfer bench of the present invention, however, lies in its ability to provide extremely stable support for the person being placed upon it. This support is accomplished through the effective clamping action provided on the front side wall of the tub in conjunction with the leg support within, and on the floor of, the tub. The latter support is in no way affected by the presence of water in the tub, as has been the case with suction cup supported legs of prior art transfer benches.

DESCRIPTION OF THE DRAWINGS

In the accompanying drawings

FIG. 1 is a perspective view of an assembled transfer bench as it would be attached to a bathtub shown in dotted lines;

FIG. 2 is an end elevation taken in the direction of the arrow 2 in FIG. 1;

FIG. 3 is an exploded perspective view taken from the front underside of the transfer bench; and FIG. 4 is a section taken on the lines 4—4 in FIG. 2.

DESCRIPTION OF THE PREFERRED EMBODIMENT

The transfer bench of the present invention is basically structured about two parallel bar members 10 and 12. Each of said bar members comprises a horizontal section 14, a first end portion 16, and a second and opposite end portion 18. When disposed over the front side wall 20 of a tub, it may be seen that the first end portion 16 curves outwardly of the front tub wall 20 and back down and around to a terminus 22 provided with a rubber tip 24. The second and opposite end portion 18 of each bar member 10, 12 curves downwardly to form a straight leg 26. The bar members 10 and 12 are preferably formed of a hollow metal tubing so that the straight leg 26 may slidably receive an adjustable footing 28, also capped with a rubber tip 30, to rest on the floor 32 of the tub. Height adjustability of the footing 28 may be accomplished by providing a series of orifices 34 in the straight leg 26, and one or more registering orifices (not shown) in the footing 28. A bolt 36 and wing nut 38 serves to secure the footing 28 at the proper height in the tub by passing it through appropriate registering orifices 34 in the leg and in the footing 28.

Another series of orifices 40 is provided in the horizontal section of the bar members 10 and 12 proximate to the first curved end portion 16. A "T" member 42, formed of a transverse sleeve 44 fitting around the horizontal section of each bar member 10 and 12, is orificed at 46 (FIG. 3) to permit passage therethrough and through one of the orifices 40 by a knob-headed bolt 48. Extending downwardly from the sleeve 44 and firmly secured thereto is a vertical element 50, the lower end of which is provided with a transverse threaded orifice 52 to carry a knob-headed threaded member 54 which may be capped with a circular plate 56.

The two bar members 10 and 12 are maintained in parallel and in a spaced relationship with each other at one end by means of a U-shaped plate 58 which carries a cushion 60. The plate 58 may have end grooves 62 into which the bar members may be received and, preferably, secured by screws 64. At the opposite end of each bar member, the spaced relationship between the bars 10 and 12 may be maintained by a rectangular tubular frame 66 secured by fasteners 68 to the straight legs of each of the bar members 10 and 12.

The main seating for the transfer bench is provided by the seating assembly 70 formed by a U-shaped tubular member 72 having a pair of parallel horizontal ends 74 to which one or more seats 76 may be secured, with the remainder 78 of the U-shaped member, including its closed end 80, being turned upwardly some ninety degrees to form a back support spanned by a cushion 82. This seating unit may be secured to the horizontal sections of the bar members 10 and 12 by knob-headed fasteners 84 passed upwardly through orifices 86 in such horizontal sections of the bar members 10, 12 and into threaded orifices 88 provided in the horizontal ends 74 of the U-shaped tubular member 72.

In use, the two bar members 10 and 12 are first brought to the tub and lightly clamped to the side wall 20. The heighth of the footing 28 is properly adjusted and secured, and the bars are properly spaced by securing thereto the cushioned plate 58 and the frame 66. At this point, necessary adjustments are made of the "T" member 44 and knob-headed threaded element 54 to provide a tight and effective clamping of the front side tub wall 20 between the rubber capped terminus 22 of the curved end portion 16 and the plate 56 on the end of the threaded element 54. The seating assembly is then placed across and secured to the two parallel bar members 10 and 12.

With the transfer bench thus assembled, the invalid may be first placed on the approach seat 60 and then slid over onto the main seat cushion 76. If able, using the grip provided by the upper transverse portion **66*a* of the frame 66, the person may ease him or herself into the tub; or be eased thereinto by the party assisting the invalid, if this is desired; or, if not, the invalid may be washed while still sitting on the main seat assembly 72**.

The entire assembly may quickly be removed from the tub simply by loosening the knob-headed threaded elements 54 and lifting the entire assembly from the tub. On the other hand, should it be desired to disassemble the transfer bench, this may readily be accomplished by removing the various knob-headed fasteners in the reverse order from the manner of assembly described above.

It may thus be seen that the transfer bench of the present invention not only provides the desired security of installation, but is light in weight and is easily installed in a tub of any configuration in a small space.

I claim:

1. A transfer bench to facilitate the movement of an infirm person or invalid from outside of a bathtub to a position at least partially within the bathtub, said bathtub being defined by a transverse floor and a wall extending upwardly from said floor to terminate in a rim, said transfer bench comprising:

A. a pair of parallel bar members spaced from each other, each of said bar members including a horizontal support section, having (i) a first end portion to be disposed transversely upon the rim of the tub side wall and to extend outside of the tub and downwardly and back to terminate in abutment against the outside of the tub side wall, the horizontal support section adjacent said first end portion of one of said bar members being held in spaced parallel relationship with the corresponding horizontal support section of the other bar member by a rigid cushioning element secured to and extending over both said horizontal support sections; and (ii) a second opposite end portion curved downwardly and extending vertically as a leg to terminate upon the transverse floor of the tub, the last said end portion of each of said bar members being secured in spaced relation to the corresponding end portion of the other bar member by a frame securable to and extending upwardly from each of said second end portions, said frame being spaced from said rigid cushion element by at least the width of a seat;

B. clamping means whereby the bench may be clamped to said tub side wall, said means comprising an element adjustably securable to, and extending downwardly from, the horizontal support section of each of said parallel bar members in proximity to its first end portion, the lower end of said adjustably securable element carrying a threaded member extending through said lower end with a first end directed toward the terminus of the first end portion of the bar member which abuts the outside of said tub side wall, said threaded member having knob means on its other end to enable the said first end of the threaded member to be adjustably moved toward or away from the inside of the tub side wall, and means disposed on said first end to distribute force, applied by the torquing of said threaded element by the knob means, over a broad area of the inner wall of the tub when said tub wall is clamped between the said means disposed on the first end of the threaded member and the terminus of the first end portion of horizontal support section of the parallel bar member, in abutment with the outside of the tub wall; and C. cushioned seating means, the last said means extending across and fixedly secured to the horizontal support section of each of said parallel bar members intermediate said frame and said rigid cushioning element.

2. A transfer bench as described in claim 1 wherein the cushioned seating means comprises a U-shaped tubular member including a pair of horizontal parallel support elements spaced from each other with the U-portion bent upwardly to form a back support, and rigid cushioning means disposed transversely over said horizontal parallel support elements, fastener means to secure each of the last said elements to, and on top of the horizontal support section of each of said parallel bar members.

3. A transfer bench as described in claim 1 wherein the downwardly extending leg of the second opposite end portion of each of said bar members is height adjustable.

4. A transfer bench as described in claim 1 wherein the downwardly extending leg of the second opposite end portion of each of said bar members is angled slightly back toward the center of the tub.

5. A transfer bench as described in claim 1 wherein each element extending downwardly from a horizontal support section and carrying a threaded member may be secured at a plurality of different locations on said horizontal support section.

6. A transfer bench as described in claim 1 wherein the means to distribute the force over a broad area of the inner wall of the tub is a cushioned plate secured on the first end of the threaded member.

* * * * *